US009753481B2

(12) United States Patent
Baker et al.

(10) Patent No.: US 9,753,481 B2
(45) Date of Patent: Sep. 5, 2017

(54) NMOS REGULATED VOLTAGE REFERENCE

(71) Applicant: HGST, Inc., San Jose, CA (US)

(72) Inventors: R. Jacob Baker, North Billerica, MA (US); Ward Parkinson, Boise, ID (US)

(73) Assignee: HGST, INC., San Jose, CA (US)

( * ) Notice: Subject to any disclaimer, the term of this patent is extended or adjusted under 35 U.S.C. 154(b) by 0 days.

(21) Appl. No.: 14/795,836

(22) Filed: Jul. 9, 2015

(65) Prior Publication Data

US 2016/0124456 A1 May 5, 2016

Related U.S. Application Data

(60) Provisional application No. 62/022,941, filed on Jul. 10, 2014.

(51) Int. Cl.
*G05F 3/16* (2006.01)
*G05F 3/26* (2006.01)

(52) U.S. Cl.
CPC ..... *G05F 3/267* (2013.01)

(58) Field of Classification Search
CPC ..... G05F 3/30; G05F 3/20; G05F 3/22; G05F 3/24
USPC ..... 323/313
See application file for complete search history.

(56) References Cited

U.S. PATENT DOCUMENTS

2009/0289669 A1* 11/2009 Seth ..... H03K 5/04 327/109
2012/0212259 A1* 8/2012 Riva ..... G01R 19/10 327/89

* cited by examiner

*Primary Examiner* — Adolf Berhane
*Assistant Examiner* — Afework Demisse
(74) *Attorney, Agent, or Firm* — Patterson & Sheridan, LLP

(57) ABSTRACT

A method and system for generating a reference voltage are disclosed. The reference voltage is generated by generating a voltage VRIGHT using a first transistor and generating a voltage VBIAS using a second transistor. The gates of the two transistors are connected to a common node VREF, but the loads of the transistors have different resistances. At least one differential pair is used to detect a difference between voltages VRIGHT and VBIAS. VREF is forced to a value at which the source-drain currents in each of the transistors is equal. The transistors sued are NMOS transistors.

8 Claims, 6 Drawing Sheets

| V | Process | Temp | Vref | Vbias | Current |
|---|---|---|---|---|---|
| 2.8 | Slow | −10 | 2.51 | .978 | 70μA |
| 3.0 | | | 2.513 | .981 | 72μA |
| 3.6 | | | 2.521 | .984 | 74μA |
| 2.8 | | 27 | 2.518 | .966 | 80μA |
| 3.0 | | | 2.523 | .968 | 82μA |
| 3.6 | | | 2.53 | .971 | |
| 2.8 | | 100 | 2.541 | .944 | |
| 3.0 | | | 2.548 | .947 | |
| 3.6 | | | 2.556 | .950 | 97μA |
| 2.8 | Tvp | −10 | 2.337 | .9185 | 67μA |
| 3.0 | | | 2.340 | .920 | 68μA |
| 3.3 | | | 2.343 | .922 | 69μA |
| 3.6 | | | 2.346 | .923 | 70μA |
| 3.8 | | | 2.348 | .924 | 70μA |
| 2.8 | | 27 | 2.334 | .9021 | 73.8μA |
| 3.0 | | | 2.337 | .9035 | 74.8μA |
| 3.3 | | | 2.340 | .905 | 76.0μA |
| 3.6 | | | 2.343 | .906 | 77.0μA |
| 3.8 | | | 2.344 | .907 | 77.4μA |
| 2.8 | | 100 | 2.333 | .873 | 86.0μA |
| 3.0 | | | 2.336 | .874 | 87.0μA |
| 3.3 | | | 2.339 | .875 | 88.0μA |
| 3.6 | | | 2.342 | .877 | 89.5μA |
| 3.8 | | | 2.344 | .877 | 90.0μA |
| 2.8 | Fast | −10 | 2.170 | .860 | |
| 3.0 | | | 2.173 | .860 | |
| 3.6 | | | 2.179 | .864 | |
| 2.8 | | 27 | 2.156 | .8396 | 69μA |
| 3.0 | | | 2.159 | .841 | 72μA |
| 3.6 | | | 2.165 | .844 | 63μA |
| 2.8 | | 100 | 2.133 | .803 | 81μA |
| 3.0 | | | 2.136 | .804 | |
| 3.6 | | | 2.141 | .906 | 83μA |

FIG. 4

| Measure @ VDD=3.3V | | | |
|---|---|---|---|
| Model | Typ | Slow | Fast |
| Temp | 27 | 0 | 100 |
| VREF | 2.134V | 2.316V | 1.895V |
| VBIAS | 0.878V | 0.951V | 0.774V |
| %_var(VREF) | 0% | −9% | 11% |
| %_var(VBIAS) | 0% | −8% | 12% |

| Measure @ VDD=3.3V | | | |
|---|---|---|---|
| Model | Typ | Slow | Fast |
| Temp | 27 | 0 | 100 |
| VREF | 1.879V | 2.060V | 1.601V |
| VBIAS | 0.507V | 0.876V | 0.694V |
| %_var(VREF) | 0% | −10% | 15% |
| %_var(VBIAS) | 0% | −9% | 14% |

NMOS REGULATED VOLTAGE REFERENCE

CROSS-REFERENCE TO RELATED APPLICATIONS

This application claims benefit of U.S. Provisional Patent Application Ser. No. 62/022,941, filed Jul. 10, 2014, which is herein incorporated by reference.

TECHNICAL FIELD

In various embodiments, the present invention relates to regulated voltage reference circuits, and in particular to integrated regulated voltage circuits made using only a single type of transistor.

BACKGROUND

Manufacture yield and rage of use by product users (power supply and temperature) for integrated circuits is enhanced by an ability to generate voltages that are relatively invariant with variation in power supply, temperature, and process. Evolution of improved art has included diode or zener clamps driven by a resistor, and then by current source to reduce variation in the current through the diodes. See Chapter 20 and 23 in CMOS Circuit Design, Layout and Simulation by Dr. R. Jacob Baker, $2^{nd}$ Edition, which is herein incorporated by reference herein in its entirety. While such circuits were often better than a resistor divider, the variation with temperature and even power supply were still substantial. These were further improved with the Widlar bandgap reference. See write-up about use of bipolar bandgap to create stable reference in U.S. Pat. No. 5,053,640, which is hereby incorporated by reference herein in its entirety. One conventional approach to providing a voltage reference has been to use temperature compensated zener diodes. Since the breakdown voltage of a zener diode is about 6 volts, however, this provides a lower limit on the input voltage employed in a voltage regulator circuit. Other disadvantages are also associated with zener diode voltage references, such as stability problems, process control problems and noise introduced into the circuit.

In another approach, the bandgap voltage of silicon is employed as an internal reference to provide a regulated output voltage. This approach overcomes many of the limitations of zener diode voltage references such as long-term stability errors and incompatibility with low voltage supplies. One such convention bandgap voltage reference is disclosed in R. Widlar, New Developments in IC Voltage Regulators, IEEE J. Solid-State Circuits, Vol. SC-6 (February 1971), which is hereby incorporated by reference herein in its entirety, and is illustrated generally in FIG. 1. In this approach, a relatively stable voltage is established by adding together two scaled voltages having positive and negative temperature coefficients, respectively. The positive temperature coefficient is provided by the difference between the base-emitter voltages of two bipolar transistors Q1 and Q2 operating at different emitter current densities (referring to FIG. 1). Since these two transistors are operated at different current densities, a differential in the emitter-base voltages of the two devices is created and appears across R3. The negative temperature coefficient is that of the base-emitter junction of transistor Q3. Thus the basic bandgap cell requires three transistors, Q1, Q2 and Q3 to achieve the offsetting temperature coefficients. It can be shown that, for theoretically perfect device operation, if the sum of the initial base-emitter voltage of Q1 and the base-emitter voltage differential of the two transistors Q1 and Q2 is made equal to the extrapolated energy bandgap voltage, which is +1.205V for silicon at T=0° K, then the resultant temperature coefficient equals zero. (The detailed derivation of this result may be found in the above-noted Widlar reference.)

However this approach uses bipolar devices, a process limitation for use with MOS and FET processes. Translating using beta-multiplier is shown in Dr. Baker's book, FIG. 23.13 with results at FIG. 23.13. And trimming means are described as are familiar to those reasonably skilled in the art. Using parasitic bipolar junction transistors in the MOS process allows approximating band-gap operation with good results. Example circuits using the parasitic bipolar devices and results are shown in FIG. 23.25 and FIG. 23.26. These approaches results in good references and are suitable for use in regulators. However, this approach requires providing the extra process step of the n-well (commonly associated with the CMOS or bi-cmos processes).

For high volume memory, especially cost sensitive commodity memory such as a Flash replacement, it is desirable to find way without these extra process steps or special transistor requirements to generate a reference. Such a preference should preferably have adequate performance to allow regulating internal nodes on the chip, such as the write voltage, by determining whether when the charge pump should be turned on and off to control the voltage generates that is above or below the power supply. And the reference can desirably be used as an input to a comparator for determining whether inputs to the chip are logic as 1s or 0s. And a regulator can be useful in the sense amp to determine memory state of signals from the memory array. Other uses may also be found by those reasonably familiar with the art for a reference and regulator generates by a lower cost process with fewer masks and process steps.

BRIEF DESCRIPTION OF THE DRAWINGS

FIG. 4 is a chart showing the simulated variation for temperature.

DETAILED DESCRIPTION

Figure 1:
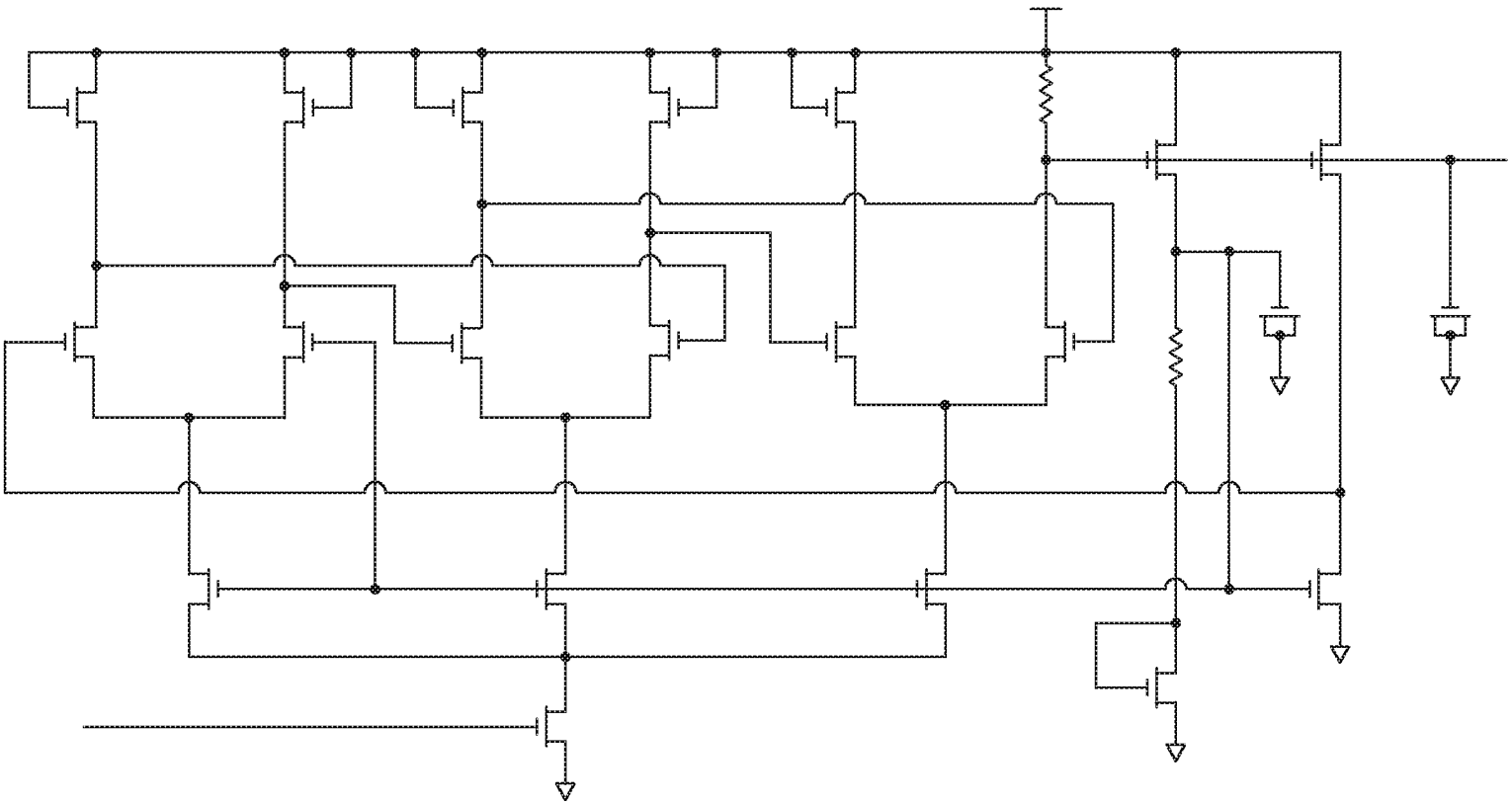
FIG. 1 (PRIOR ART)
FIG. 1 is a schematic circuit diagram.

Referring to FIG. 1 schematic, the input is vdd (top right), normally forced in the range of 2.7-3.6V. The minimum voltage is determined by when the reference (VREF) is adequately within range of its desired output, for example 2.5V. The maximum voltage is determined by the maximum voltages allowed across the transistors or circuit, for example 4.3V for a 50 nm process. This voltage may be higher or lower for a different process, minimum L, minimum width, gate oxide thickness and other process variables as will be apparent to those reasonably skilled in the art. Circuit is active when enable input, EN, is logic high.

Figure 5:
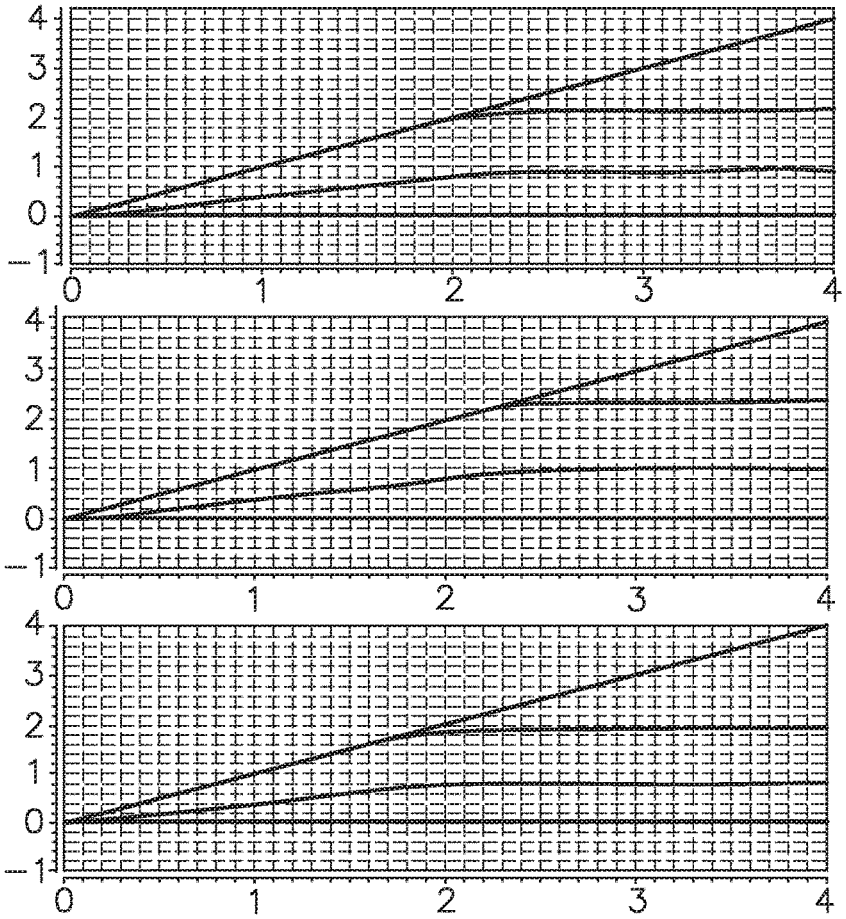
FIG. 5 is chart and graphs showing VREF optimization.

The output shown in FIG. 1 is VREF. For the configuration and sizes of transistors shown, the VREF may be relatively constant and at about 2.3V with little variation for changes in power supply and temperature, such as from 2.5-4V for the vdd input and for temperatures from −55 to 100 C. or even higher. The nominal 2.3V value for typical will change with variation in process, such as in Vt. For example at lower Vt, the VREF output will be about 2.15V, but still with little variation for changes in input power supply and temperature for Vdd >2.5V. And for higher Vt, the VREF output will be 2.5V, again with little variation for changes in power supply and temperature above about 2.7V. Examples in variation for different input, temperatures, and process (Fast, Typical, and Slow) are shown in FIG. 4 and FIG. 5.

Figure 2:
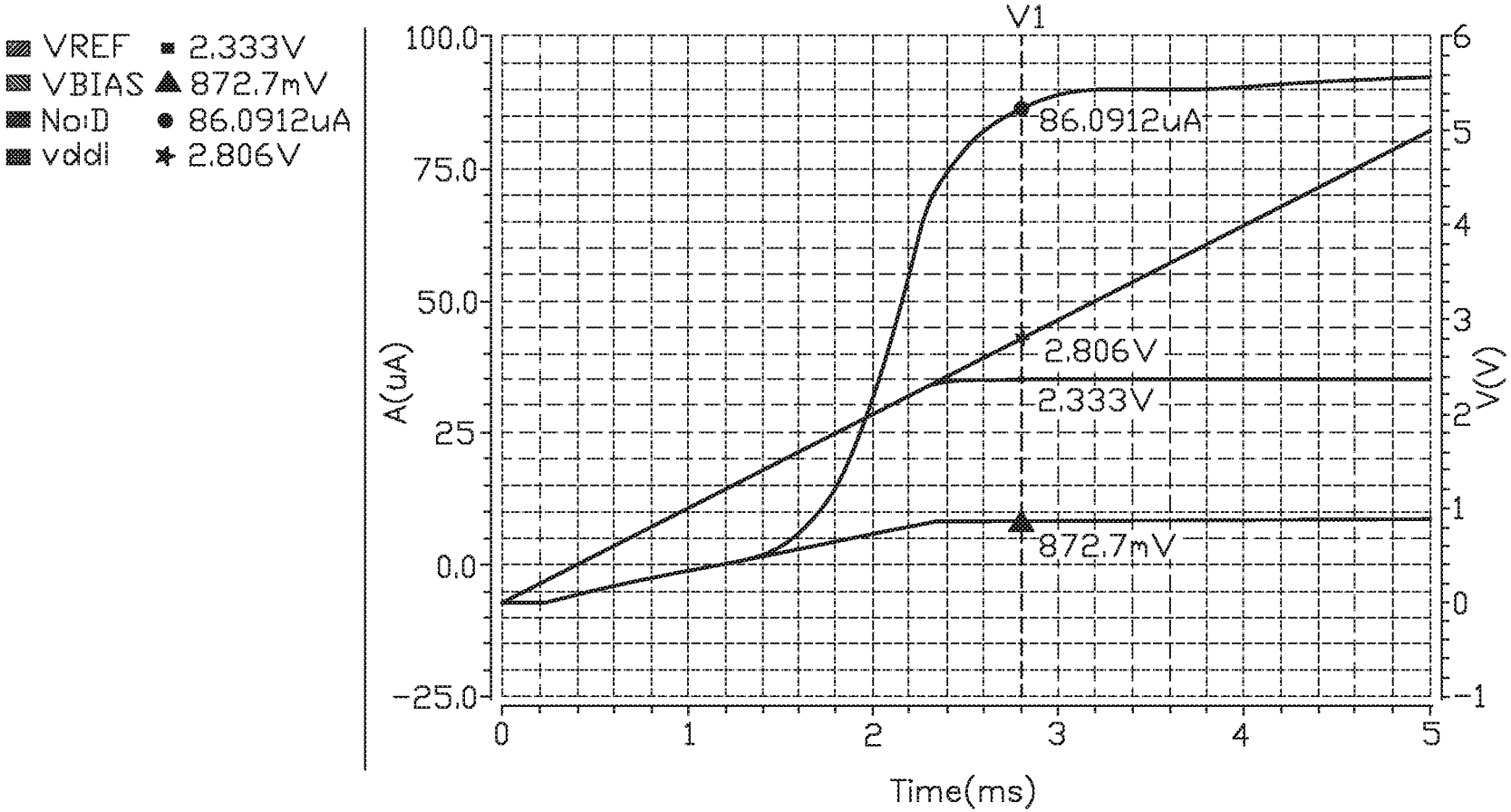
FIG. 2 (PRIOR ART)
FIG. 2 is an example plot of a simulation at 100 C. for typical process.

FIG. 2 is an example plot of a simulation at 100 C. for typical process. As the power supply, Vdd (labeled "vdd!), is varied from 0 to 5V, the output VREF rises with the increasing power supply until regulation begins and the output stays at about 2.3V as vdd! Increases. Also plotted is the bias voltage VBIAS, a self-adjusted node voltage created within the reference, which drives and biases the current sources—the transistors with gas to VBIAS and Source to drain of transistor N10 (with gate tied to chip EN). As shown in FIG. 2, current to operate the Reference circuit is about 90 ua for high Vdd at 100 C. When the Reference is not being used (such as when the chip is in standby), this current is eliminated by lowering the EN from high to low, which is desirable in standby to improve time between battery recharge in a mobile device.

As can be seen in the FIG. 2 plot, the current (N0:d) increases smoothly as VREF comes alive and starts up towards its flat zone around 2.3V, where the current goes relatively flat also and stops increasing with increasing Vdd (above about 2.7V in this plot for the devices sizes chosen to regulate around 2.3V).

Figure 3A:
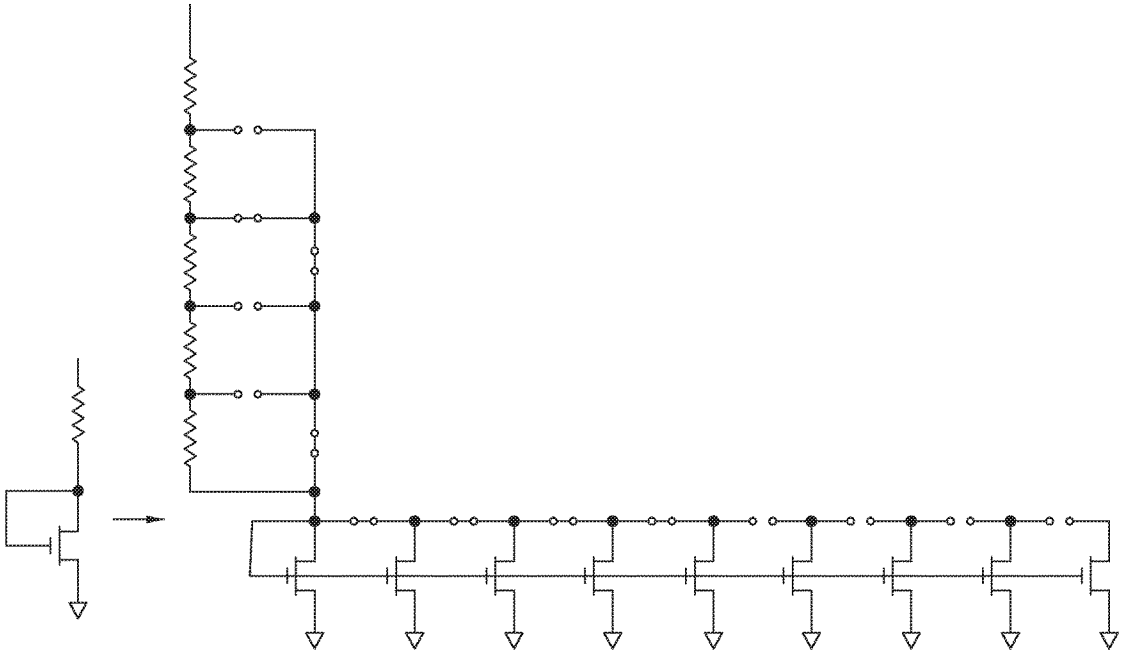
FIG. 3A is a circuit diagram.
Figure 3B:
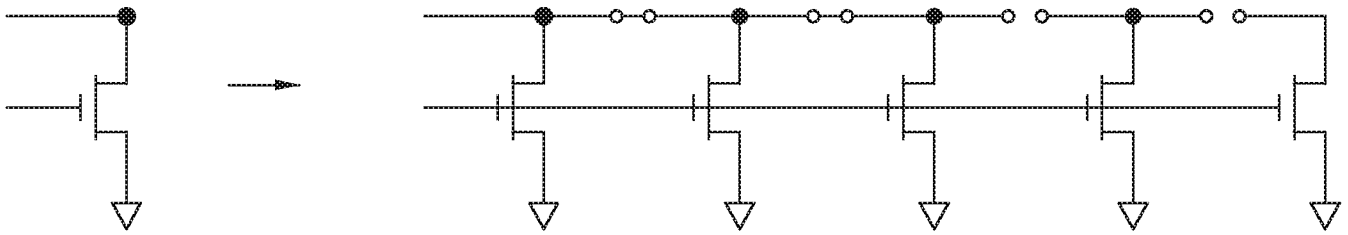
FIG. 3B is a circuit diagram.
Figure 3C:
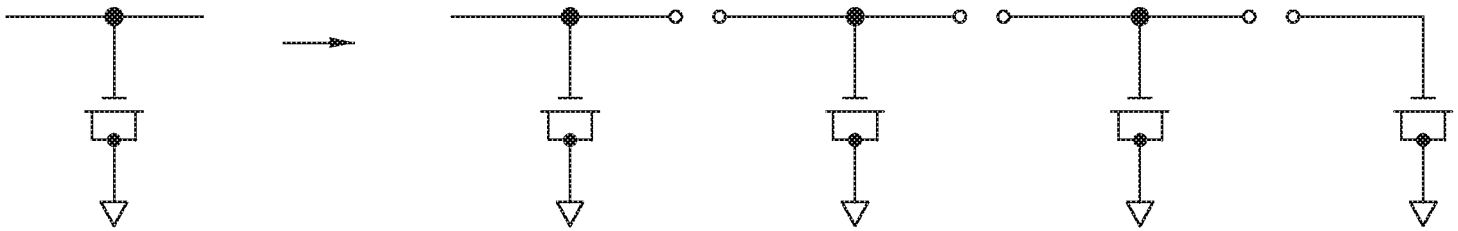
FIG. 3C is a circuit diagram.

Considering FIG. 4, the simulated variation for temperature from −20 to 100 C. for 3.6Vdd and Slow Process is 2.556−2.521=0.035V or about 1.4%. The variation for Vdd from 2.8V to 3.6V at room temp and Slow Process is 2.53−2.518=0.12V or 1%. And the variation from Slow to Fast Process at 3.6V and room temp is 2.53−2.165=0.365V or 14%. As is typical, most of the variation is for changes in process, but on a given chip for a given process, the change for temperature and voltage is far less. Accordingly, the regulator output can be adjusted by fuse or bonding adjustment to re-center the output if desired. Such adjustment in centering can be made, for example as shown in FIG. 3A, by opening or closing the connection to transistors N18, 21, 22, 25-30 or N19, 23, 24, 31, 32 or by shorting or engaging resistors R4-7 as will be apparent to those reasonably skilled in the art. Such re-centering can be done by simulating the process to determine best and most optimum adjustments to achieve desired centering, such as at nominal 3Vdd. As shown in FIGS. 3A-3C, such adjustments are made by metal options but the connections could be changed by fuse, anti-fuse, or bonding pads to high or low which are connected to transistors that open or short the connections shown, since the currents involved are small so higher impedance is not a significant issue.

As shown in FIG. 5's bottom plot, the centering can be changed by changing device sizes. For that version of device sizes, the flat voltage is closer to 2.1V and variation is between 1.9-2.3V for different process conditions. Or in another version centered even lower, the variation is from 1.6-2.1V for the REFERENCE output VREF. For the choices made here in lower flat zone output VREF which results in it regulating at a lower Vdd, the results for process changes show a larger % variation . . . increasing to 10% in the top chart and 15% as shown in the charge below for the lower VREF output flat zone level. Further optimization at these lower VREF voltages is possible by varying not just the resistor and transistors adjusted with metal options but also other devices in the circuit, as will be apparent to one reasonably skilled in the art using incremental analysis on cause and effect.

As is shown in the first slide of FIG. 5, optimizing the VREF can lower variation on a given process for variations in temperature . . . here from 10% to even <1% (for nominal 3.3Vdd). The variation due to Vdd can be significantly less than 5% total variation for a +/−10% variation in Vdd (from 2.8-3.6V, as is shown in the data of FIG. 4). The circuit continues to regulate well as Vdd is increased above 3.6V and tends to be limited by the Vmax allowed by the transistors in the circuit. Adaption of the circuit to tighter (such as 30 nm) or looser geometries (90 nm) relative to the 50 nm used for this REFERENCE will be apparent to one skilled in the art by varying all device sizes and simulating for cause and effect.

Feedback with gain is provided by the 3 gain stages rippling through true and compliment from the initial stage to the middle stage and then to the output gain stage, with current respectively from N13, N12, and N8. In turn the signal is developed in the 3 stages respectively across load transistors pairs: N6 and N7, N5 and N4, N3 and R0. For the initial stage VBIAS and VRIGHT apply differential voltage across transistor gates N9 and N15, with their drains driving the differential inputs to the middle stage: the gates of transistors N10 and N16, with their drains in turn driving the transistor gates of the 3$^{rd}$ gain stage: N11 and N17. This final 3$^{rd}$ stage has a load transistor N3 with output unused but keeping the drain of differential transistor N11 high. A resistor R0 is used instead of a transistor to assist startup and initial gain as Vdd starts to exceed the flat zone VREF output voltage, though it is possible to also use transistor in place of R0. That is, the other load transistors can be replaced with resistors. And fewer or additional gain stages may be used, depending on results requires; where the additional stages can provide additional gain and less variation but at the possible negative of less stability and more tendency to oscillate depending on load (capacitance and resistance).

A basic feature of this regulator reference is current density different between the connections between VREF to VBIAS and between VREF and VRIGHT. N2 produces one Vt drop down from VREF and similar transistor N1 produce the other Vt drop. The source of N1 drives VRIGHT directly and the source of N2 drives VBIAS directly. However the loads on each of these "source followers" is different. Accordingly for VRIGHT to equal VBIAS, VREF must go to a voltage that produces the same current through each. However, the loads are different which allows VREF to find stable voltage or "operating point" as Vdd and temperature are varied. This is akin to the band-gap approach used in bipolar regulators.

Here, load on the source of N2 is a resistance into a diode, D1 made from an NMOS transistor wires with its gate connected to its drain which are the several larger diodes in parallel. Whereas the load on the source of N1 is smaller diode with no resistance. Accordingly, with equal currents flowing, the voltage across the resistor, R, must offset the difference in voltage across the transistors due to the difference in size, and hence current density in each. For example, the transistors in the leg to VBIAS may be sized 50/1 u (by wiring 5 10/1 u transistors in parallel, as shown in FIG. 3A) that are in series with the 4K resistor, R, from VBIAS. The other leg from VRIGHT has 3 transistors in parallel to ground that are sized 6/1 u+2/1 u+2/1 u to equal 10/1 u loading the N1 source of the transistor from VREF to VRIGHT (as shown in FIG. 3B). Thereby, at equal currents, the current density voltage difference is about 50 mV and the resistor is about 4K ohms, the current will be about 12 ua in each leg. These voltage differences and currents will vary with variations in temperature and process and Vdd.

Using a larger resistor for R0 will result in larger gain but slower feedback, which can be adjusted for desired VREF variation and stability. Here, the loads on VREF and VBIAS and VRIGHT may be about 10 u×10 u transistors with gate to the respective node and source-drain to ground (a capacitive load on VRIGHT, omitted from FIG. 1, would be the same as is shown for VREF in FIG. 3C). Such load may be varied along with the actual circuit loading the VREF to obtain stable VREF that does not oscillate. Oscillation is desirably avoided or minimized since the swing may be asymmetrical so that average may shift and VREF will be different when the output is oscillating (unstable) versus stable, with the capacitor providing an averaging that allows use even if oscillating. Such loading capacitor may be made adjustable as is shown in FIG. 3C, here by metal option to open or close the connection to transistor N33, the load capacitance may be allowed to decrease or increase the load capacitance respectively.

The "come alive" voltage on Vdd is the Vdd voltage (VddMin) at which VREF is adequately close to its regulated value, which may be called the flat zone. This VddMin voltage is preferably lower in battery driven mobile applications where the battery can last longer if Vdd works lower. It is lowered by tying the current sources directly to Ground instead of scaling a resistor between the source of the current source transistors (gate to VBIAS) and Ground. Any drop across the source resistor will raise VddMin. Here shown is the version where the source connects to ground. As a variation, source resistor may be added to the current sources as will be apparent to those reasonably skilled in the art. Such resistors raise VddMin but improve yield since the transistors need not be so well matched.

Also, the Reference is preferably generated on a sub wire from ground so that current travels only within the REFERENCE circuit, and drops between transistors to ground are not the result of current passing along ground from one Reference circuit to another circuit on the trip. The current should preferably dead-end within the REFERENCE to improve stability and matching. Further, a separate pad and/or wire may be from Vdd to the Reference. Such separate pad can be bonded separately to the Vdd post in the package to reduce variation in Vdd to the REFERENCE. Such other techniques to improve stability and variation will be apparent to those reasonably skilled in the art.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporation the concepts disclosed herein may be used without departing from the spirit and scope of the invention. Accordingly, the described embodiments are to be considered in all respects as only illustrative and not restrictive.

What is claimed is:

1. A system for generating a reference voltage, the system comprising only NMOS transistors or resistors and capacitors:

a first transistor for generating a voltage VRIGHT on its source and having a first load;

a second transistor for generating a voltage VBIAS on its source and having a second load, wherein the gates of the first and second transistor are connected to a common node VREF, and wherein the first and second loads comprise different resistances; and at least one differential pair for detecting a difference between voltages VRIGHT and VBIAS and generating a signal related to the difference, wherein the signal related to the difference is connected to VREF, thereby forcing VREF to a value at which the source-drain currents in each of the first and second transistors are equal and wherein all the transistors are NMOS.

2. The system of claim 1, wherein the at least one differential pair comprises a single differential pair, two stages of differential pairs, or there stages of differential pairs.

3. The system of claim 1, wherein the first load or the second load comprises a resistor R.

4. The system of claim 1, wherein the at least one differential pair generates the signal with an output resistor R0.

5. The system of claim 4, wherein R0 is sized larger for greater gain or smaller for greater feedback.

6. A method for generating a reference voltage using only NMOS transistors or resistors and capacitors, the method comprising:

generating a voltage VRIGHT using a first transistor having a first load;

generating a voltage VBIAS using a second transistor having a second load, wherein the gates of the first and second transistor are connected to a common node VREF, and wherein the first and second loads comprise different resistances;

detecting a difference between the voltages VRIGHT and VBIAS using at least one differential pair and generating a single related to the difference; and forcing VREF to a value at which the source-drain currents in each of the first and second transistors are equal using only NMOS transistors.

7. The method of claim 6, further comprising generating the single related to the difference with an output resistor R0.

8. The method of claim 7, further comprising sizing R0 larger for greater gain or smaller for greater feedback.

* * * * *